US008046865B2

(12) United States Patent
Knopow et al.

(10) Patent No.: US 8,046,865 B2
(45) Date of Patent: Nov. 1, 2011

(54) CLEANING TOOL WITH CLEANING PAD HAVING A NON-WOVEN FIBER BUNDLE ON BOTH SIDES

(75) Inventors: Jeremy F. Knopow, Burlington, WI (US); David A. Hoadley, Racine, WI (US); Chrissie M. Smits, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 165 days.

(21) Appl. No.: 11/750,204

(22) Filed: May 17, 2007

(65) Prior Publication Data

US 2007/0209134 A1 Sep. 13, 2007

Related U.S. Application Data

(63) Continuation of application No. 11/106,960, filed on Apr. 15, 2005, now Pat. No. 7,356,869.

(51) Int. Cl.
*A47L 13/10* (2006.01)
*A47L 13/38* (2006.01)
*B08B 9/00* (2006.01)

(52) U.S. Cl. ..... 15/210.1; 15/209.1; 15/234

(58) Field of Classification Search ..... 15/104.31, 15/159.1, 160, 172, 209.1, 210.1, 234
See application file for complete search history.

(56) References Cited

U.S. PATENT DOCUMENTS 377,582 A 2/1888 Stewart
566,570 A 8/1896 Frick
782,669 A 2/1905 Lea
823,725 A 6/1906 Hayden
986,268 A 3/1911 Colina et al.
1,261,444 A 4/1918 Schied
1,466,723 A 9/1923 Izawa
1,559,900 A 11/1925 McCarthy
1,588,737 A 6/1926 Hurd
1,608,347 A 11/1926 Thompson
1,796,001 A 3/1931 Church
1,844,443 A 2/1932 Markowitz
1,928,328 A 9/1933 Carpentier
2,003,243 A 5/1935 Campbell et al.
2,062,065 A * 11/1936 Miley ..... 15/210.1
2,254,365 A 9/1941 Griffith et al.
2,303,660 A 12/1942 Schickel
2,438,268 A 3/1948 Bressler
2,479,224 A 8/1949 Flinn
2,529,952 A 11/1950 Leunis
2,746,074 A 5/1956 Carlson, Sr.
2,871,497 A 2/1959 Miller et al.
2,877,482 A 3/1959 Roy
3,066,344 A 12/1962 Borras et al.
D198,742 S 7/1964 Bennett
3,205,518 A 9/1965 Romaine
3,360,818 A 1/1968 Edwards
4,145,787 A 3/1979 Bastian
4,195,625 A * 4/1980 Bukowski ..... 601/141
4,227,278 A 10/1980 Raskin et al.
4,483,037 A 11/1984 Jacobson
4,683,875 A * 8/1987 Rabinowitz ..... 601/141
4,765,014 A 8/1988 Moss et al.
(Continued)

*Primary Examiner* — Randall Chin
(74) *Attorney, Agent, or Firm* — Boyle Fredrickson, S.C.

(57) ABSTRACT

A flexible cleaning tool (22) is disclosed. The cleaning tool (22) includes a handle (24) connected to an elongated flexible support member (26) that includes a plurality of discrete, rotatably interconnected segments (40). A cleaning pad (28) encloses the support rod (26).

18 Claims, 3 Drawing Sheets

U.S. PATENT DOCUMENTS

| | | | | |
|---|---|---|---|---|
| 4,827,556 | A | 5/1989 | Corsetti | |
| 4,829,621 | A | 5/1989 | Phenegar | |
| 4,908,900 | A | 3/1990 | McLaughlin et al. | |
| 4,926,522 | A | 5/1990 | Wang | |
| 4,949,496 | A | 8/1990 | Stephan | |
| 4,967,441 | A | 11/1990 | White | |
| 5,032,015 | A | 7/1991 | Christianson | |
| 5,033,155 | A | 7/1991 | Klotz | |
| 5,033,528 | A | 7/1991 | Volcani | |
| 5,279,048 | A | 1/1994 | Lawall et al. | |
| 5,449,006 | A | 9/1995 | Hogan et al. | |
| 5,449,206 | A | 9/1995 | Lockwood | |
| D364,016 | S | 11/1995 | Aronson | |
| 5,479,951 | A | 1/1996 | Denebeim | |
| D371,655 | S | 7/1996 | Weston | |
| 5,555,588 | A | 9/1996 | Viesehon | |
| 5,806,128 | A | 9/1998 | Love | |
| 5,836,032 | A | 11/1998 | Hondo | |
| 5,997,047 | A | 12/1999 | Pimentel et al. | |
| 6,042,155 | A | 3/2000 | Lockwood | |
| D428,225 | S | 7/2000 | Prime et al. | |
| 6,082,583 | A | 7/2000 | Bussell et al. | |
| 6,086,759 | A | 7/2000 | Bisseker | |
| RE36,883 | E | 9/2000 | Krenzel | |
| D435,948 | S | 1/2001 | Long | |
| 6,182,321 | B1 | 2/2001 | Wu | |
| 6,230,356 | B1 | 5/2001 | Hyo-Moon | |
| 6,237,184 | B1 | 5/2001 | Leneghan | |
| 6,505,373 | B2 | 1/2003 | Van Gelder et al. | |
| 6,601,260 | B2 | 8/2003 | Lenaghan | |
| 6,739,787 | B1 | 5/2004 | Bystrom | |
| 6,742,951 | B2 * | 6/2004 | Schultz et al. | 401/139 |
| 6,775,873 | B2 | 8/2004 | Luoma | |
| D500,183 | S | 12/2004 | Bensussan et al. | |
| D504,199 | S | 4/2005 | Bensussan et al. | |
| 6,978,509 | B2 * | 12/2005 | Lin | 15/229.7 |
| 2002/0120993 | A1 | 9/2002 | Busha | |
| 2003/0014827 | A1 | 1/2003 | Gray et al. | |
| 2003/0102010 | A1 | 6/2003 | Mays | |
| 2004/0016074 | A1 | 1/2004 | Tanaka | |
| 2005/0183225 | A1 | 8/2005 | Wang | |
| 2005/0191116 | A1 | 9/2005 | Flanery et al. | |
| 2005/0198760 | A1 | 9/2005 | Tanaka et al. | |
| 2006/0048325 | A1 | 3/2006 | Tsuchiya | |
| 2006/0051434 | A1 | 3/2006 | Tsuchiya | |

* cited by examiner 26
4
4

28
2°
3
3
20
24
22
24
34
27
30
31

FIG. 5
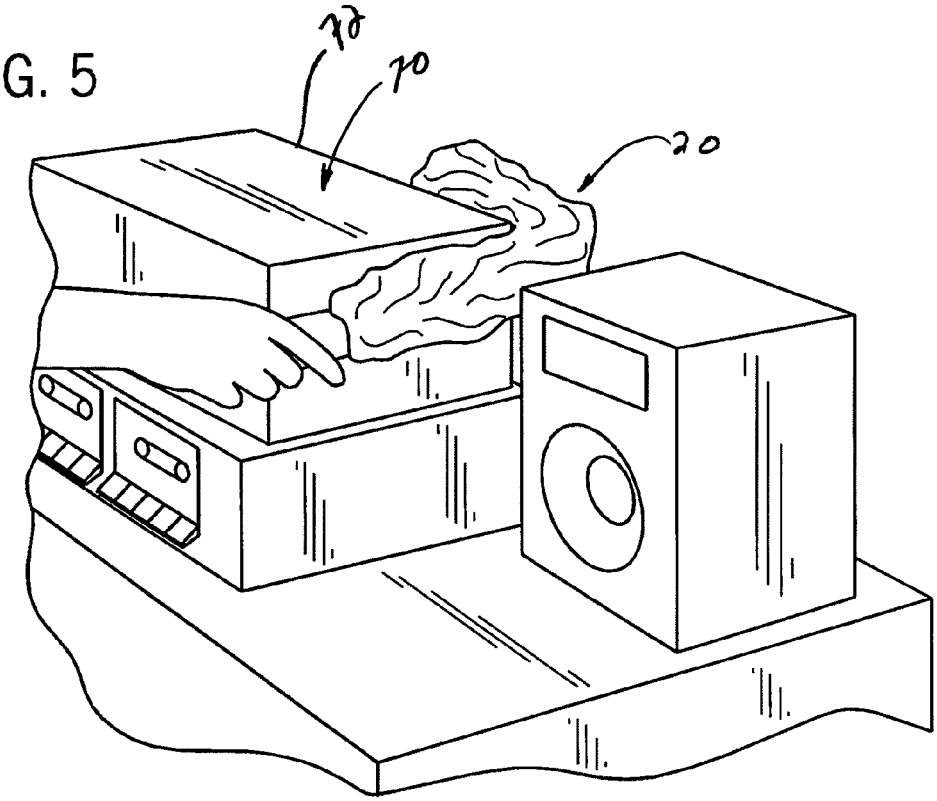
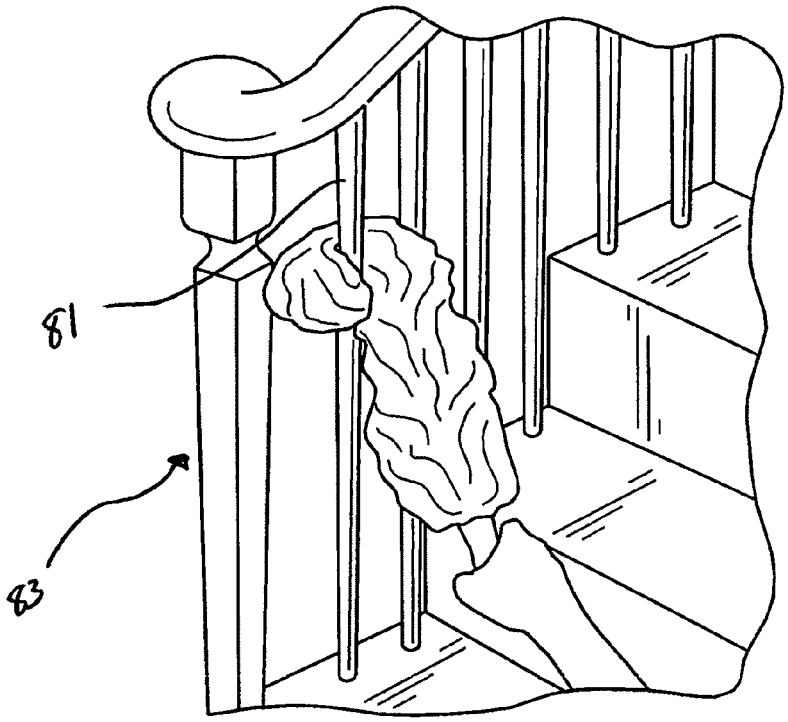
FIG. 6

CLEANING TOOL WITH CLEANING PAD HAVING A NON-WOVEN FIBER BUNDLE ON BOTH SIDES

CROSS-REFERENCE TO RELATED APPLICATION

This application is a continuation of application Ser. No. 11/106,960 filed Apr. 15, 2005 now U.S. Pat. No. 7,356,869.

BACKGROUND OF THE INVENTION

1. Field of the Invention

The present invention relates to the field of cleaning devices such as hand held dusters and dust mops, bathroom cleaners, toilet cleaners and other cleaning devices. More particularly, the present invention relates to a flexible cleaning device for accommodating the cleaning or dusting of difficult to access surfaces.

2. Discussion of the Related Art

For decades, hand held feather dusters, dust rags and other cleaning implements have been used as cleaning tools for the removal of dust adhering to furniture such as dressers and coffee tables, electrical appliances such as computers, lights, interior walls, lintels and the like. Thus, it is generally well known to remove dust or dirt from floors, furniture, and other household surfaces by rubbing a dust rag, cloth or other cleaning implement against the surface to be cleaned such that the dust or dirt adheres to the cleaning implement.

Despite the existence of numerous dusting or cleaning implements, dusting or cleaning of surfaces in hard to reach and inaccessible areas remains a common problem. Currently, in order to clean behind heavy appliances such as televisions or stereos, a user must physically move the appliance to enable the user to adequately clean behind the desired appliance. Certain fixtures, such as radiators in older homes are immovable and present a significant challenge for cleaning. Likewise, other odd shaped or difficult to reach surfaces such as the inner rim of a toilet seat or the spindle on a staircase provide challenges to cleaning.

While hand held dusters and other cleaning implements are generally well known in the art, numerous drawbacks exist with the current commercially available designs. For example, US Application Pub. No. US 2004/0034956 A1, U.S. Pat. Nos. 6,813,801, 5,953,784 and 6,550,092, hereby expressly incorporated by reference, disclose variations of hand held cleaning devices incorporating a disposable cleaning pad. These devices, while somewhat suitable for the desired application, exhibit notable limitations. For example, none of the above-cited references provide an elongated flexible support arm that allows a user to bend the duster or cleaning device into a variety of shapes. Instead, most prior art hand held dusters or cleaners utilize rigid supports that do not allow a user to shape the duster into unique configurations to enable the user to dust or clean behind hard to reach places. While some prior art devices exhibit a movable joint to enable better storage or shipping, such devices are typically constructed to be flexible only in the one direction, and as such its cleaning capability is restricted by its maneuverability. The duster of the present invention overcomes the disadvantages of the prior art since, inter alia, it is constructed of an elongated rod which is flexible in all directions.

In general, the majority of improvements to hand held dusters and mops have been directed at improving the basic mechanical components of the cleaning device. These improvements have been directed at providing an inexpensive yet robust implement for dry dusting or cleaning. However, notably absent in the prior art is any attempt to provide a hand held cleaning implement that allows for rotational movement to allow for a flexible cleaning device.

Likewise, the cleaning surface of the cleaning implement in many of these devices is relatively small, such that use of these cleaning devices on large surfaces requires considerable effort on the user's part. In addition, most prior art cleaning pads, only include a single cleaning surface. The duster of the present invention overcomes the disadvantages of the prior art since, inter alia, it is constructed of an elongated 360° cleaning surface.

SUMMARY AND OBJECTS OF THE INVENTION

Consistent with the foregoing, and in accordance with the invention as embodied and broadly described herein, a cleaning device, a cleaning system, and a method of cleaning are disclosed in suitable detail to enable one of ordinary skill in the art to make and use the invention.

In one embodiment, a cleaning device includes a handle and an elongated flexible support rod attached to the handle capable of being moved into a plurality of different shapes, a retaining means for retaining the elongated flexible support rod in a desired shape and a cleaning pad enclosing the support rod. The elongated support rod may be constructed from a plurality of interconnected segments.

In another embodiment, the plurality of interconnected segments comprise a plurality of discrete rotatable interconnected segments having a male end and a female end for connecting to an adjacent discrete rotatably interconnected segment. Each of the discrete rotatable interconnected segments includes a central body portion, a male end portion at an end, and a female body portion at another end of the central body portion. Each of the discrete rotatable interconnected segments has a longitudinal axis, the male end portion of a first segment has an outer surface comprising a frustum of a sphere and the female end portion of a second segment that is rotatably interconnected to the first segment has an inner surface comprising a frustum of a sphere and dimensioned to receive the male end portion of the first segment to permit relative movement between the rotatably interconnected first and second segments so that the longitudinal axes of the first segment and the second segment are either in or out of alignment and to permit rotational movement therebetween.

In yet another embodiment, the retaining means is the frictional force between the outer surfaces when the male end portion of the first segment is within the female end portion of the second segment to retain interconnected segments in the shape to which they have been moved. In still another embodiment, the handle and the elongated flexible support rod define a fluid passageway therebetween.

In another embodiment, the cleaning pad defines an elastic sleeve configured to receive the cleaning pad support member and secure the cleaning pad to the cleaning pad support member. In one embodiment, the cleaning surface of the cleaning pad extends about 360° around the cleaning pad support member. In another embodiment, the portion of the flexible support member nearest the handle is tighter than the portion of the flexible support member nearest the end.

In still another embodiment, a cleaning system includes a cleaning tool having a handle and an elongated flexible support member capable of being formed into a plurality of differing shapes, wherein the elongated flexible member is constructed from a plurality of discrete rotatable interconnected segments and a cleaning pad enclosing the support member that includes a 360° cleaning surface. In another embodiment, the plurality of discrete rotatable interconnected segments have a male end and a female end for connecting to an adjacent discrete rotatably interconnected segment.

In yet another embodiment, of the discrete rotatable interconnected segments comprises a central body portion, a male end portion at an end, and a female body portion at another end of the central body portion and each of the discrete rotatable interconnected segments has a longitudinal axis. The male end portion of a first segment has an outer surface comprising a frustum of a sphere and the female end portion of a second segment that is rotatably interconnected to the first segment has an inner surface comprising a frustum of a sphere and dimensioned to receive the male end portion of the first segment to permit relative movement between the rotatably interconnected first and second segments so that the longitudinal axes of the first segment and the second segment are either in or out of alignment and to permit rotational movement therebetween. In one embodiment, the retaining means comprise the frictional force between the outer surfaces when the male end portion of the first segment is within the female end portion of the second segment to retain interconnected segments in the shape to which they have been moved.

In another embodiment, a method of cleaning includes providing a cleaning tool comprising an elongated flexible support member constructed from a plurality of discrete, rotatably interconnected segments and a cleaning pad enclosing the support rod, bending the flexible support member is to a desired cleaning position and moving the cleaning pad across a surface to be cleaned. In another embodiment, the cleaning pad defines an elastic sleeve configured to receive the cleaning pad support member and secure the cleaning pad to the cleaning pad support member. In still another embodiment, the cleaning surface of the cleaning pad extends about 360° around the cleaning pad support member. In another embodiment, the portion of the flexible support member nearest the handle is tighter than the portion of the flexible support member nearest the end.

In a final embodiment, a cleaning system includes a handle, an elongated flexible support rod capable of being moved into a plurality of different shapes, a retaining means for retaining the elongated flexible support rod in a desired shape and a cleaning implement attached to the support rod. The elongated support rod may be comprised of a plurality of discrete rotatable interconnected segments having a male end and a female end for connecting to an adjacent discrete rotatably interconnected segment. In one embodiment, the cleaning implement is a duster.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 5 is a perspective view of the cleaning device being used to clean behind a stereo; and FIG. 6 is a perspective view of the cleaning device being used to clean a spindle of a staircase.

Figures 1, 3:
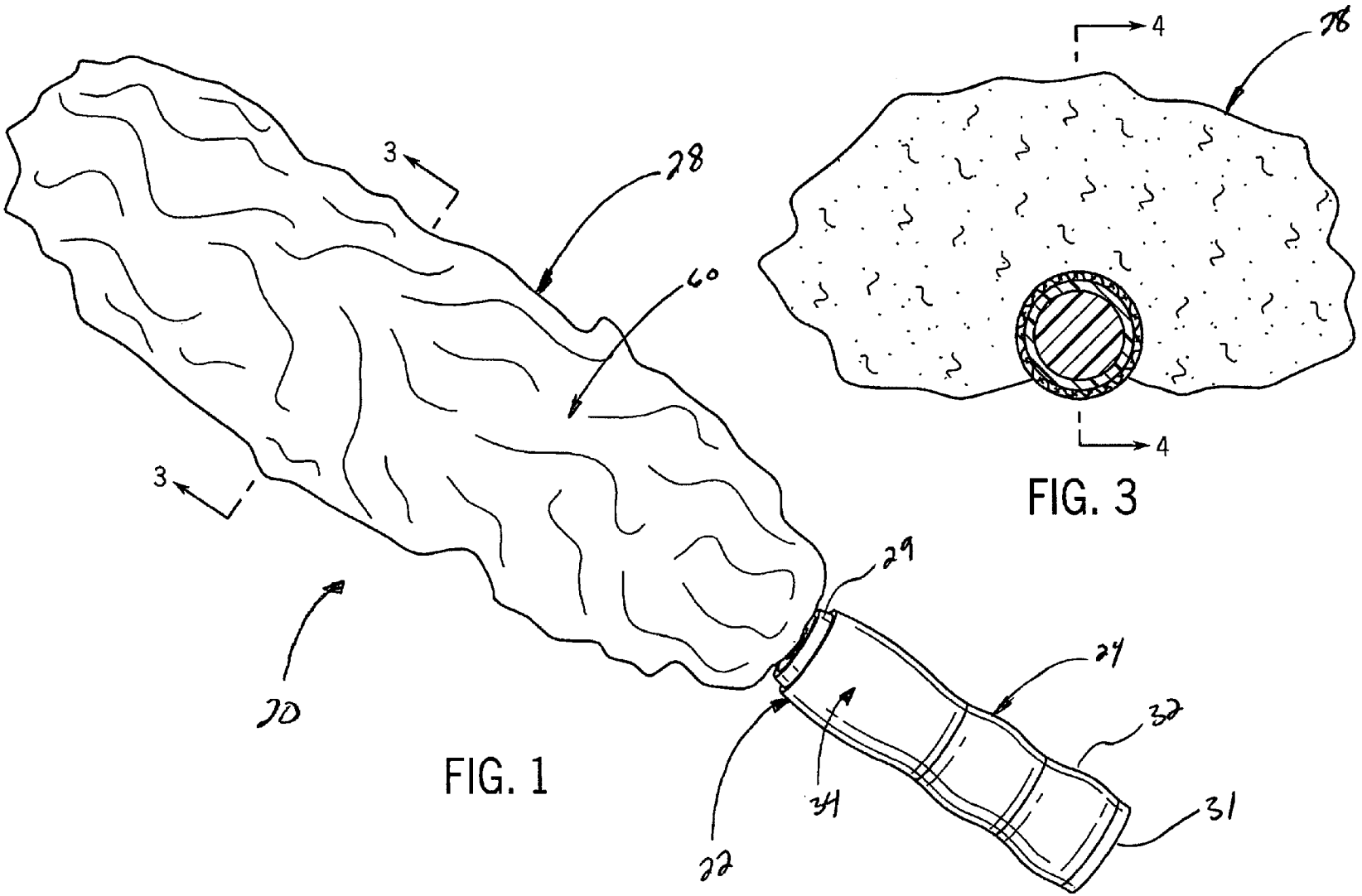
FIG. 1 is a perspective view of a first embodiment of an assembled flexible cleaning device.
FIG. 3 a sectional view taken along line 3-3 of FIG. 1.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

In a basic form, the invention is a flexible cleaning system that includes a handle, cleaning pad or duster, and a flexible cleaning pad support capable of supporting a cleaning pad or other cleaning implement. The cleaning system allows a user to dust in a variety of different places because the flexible cleaning pad support can be formed into a variety of shapes. Despite its flexibility, the support maintains its shape. A 360° cloth allows the system to be used to clean multiple surfaces at once.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figures 2, 4:
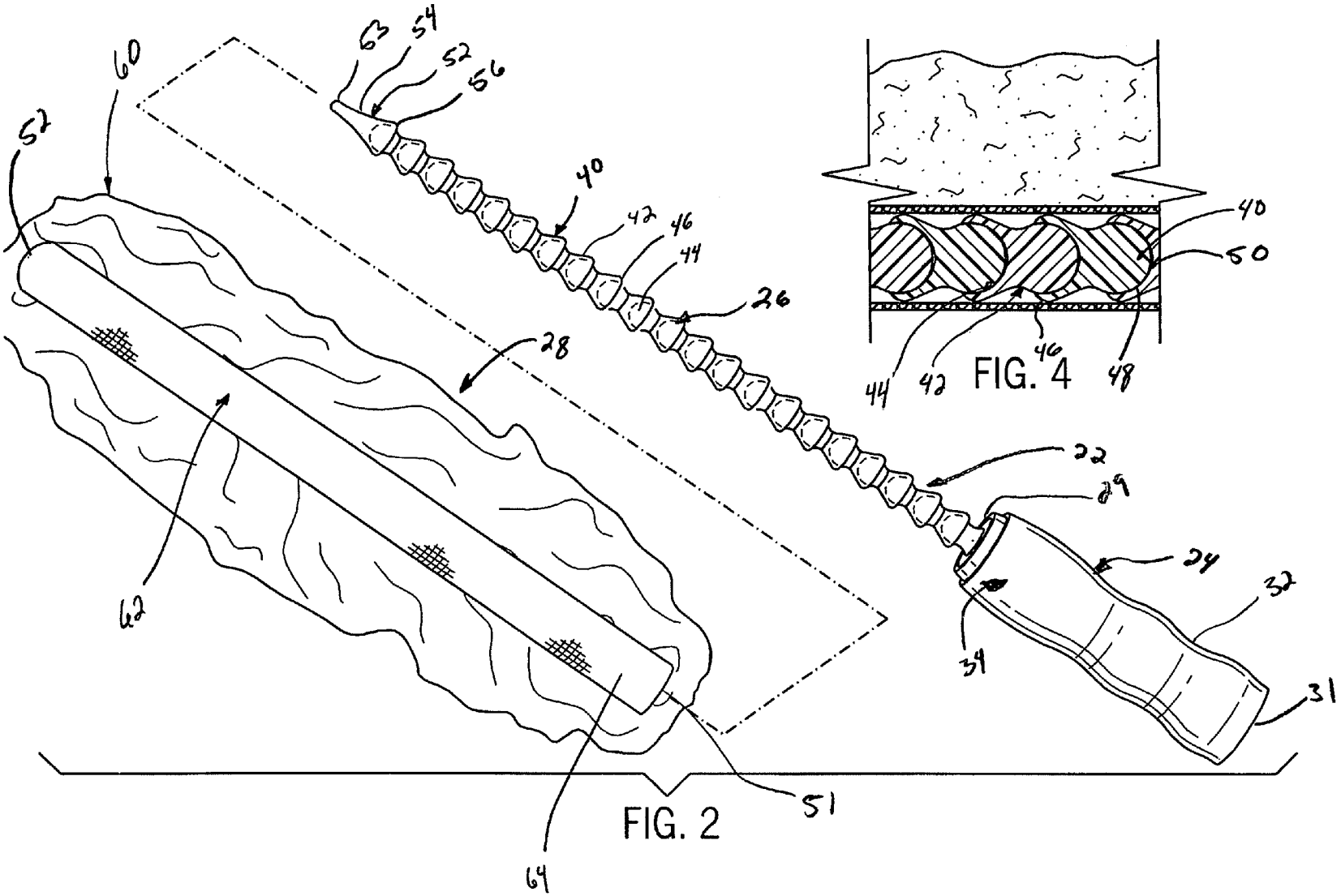
FIG. 2 is an exploded perspective view of the component parts of the cleaning device illustrated in FIG. 1.
FIG. 4 is a sectional view taken along line 4-4 of FIG. 3.

Turning initially to FIGS. 1 and 2, the inventive cleaning system 20 is illustrated according to one preferred embodiment of the present invention. Cleaning system 20 is generally comprised of a cleaning device or tool 22, including a handle portion or handle 24 and attached flexible cleaning pad support member, flexible support rod or flexible support member 26, and a cleaning pad or cleaning implement 28 attached to the cleaning tool 22 via the cleaning pad support member 26.

Handle portion 24 is preferably an ergonomically designed member configured to comfortably fit within the palm of a hand of a user. Handle portion 24 includes an integral forward cleaning pad support member connection surface 29, bottom 31, and ergonomic side 32. Handle portion 24 may be constructed from a variety of synthetic resins, plastics or other suitable materials. In the preferred embodiment, handle portion include a soft cover 34 for comfortable use by a user. The cover 34 may be made from foam, rubber or other known soft materials. Although the handle portion 24 may be constructed in a wide variety of sizes depending on the intended use, in the preferred embodiment, handle portion 24 is approximately 5.2 inches long. The preferred dimensions allows for ease of use, manipulation, packaging, shipping and storage of the cleaning system 20 as well as increasing the overall ergonomics of the design. Handle portion 24 may be constructed in a variety of colors for increased aesthetic appeal. It may additionally be constructed from a translucent material. The handle portion 24 could also house an extension element for added reach or allow for the connection of an extension element.

Attached to the handle portion 24 is the flexible cleaning pad support member 26. The flexible cleaning pad support member 26, may be attached to the handle portion 24 in a variety of conventional ways. The elongated flexible cleaning pad support member 26 is capable of being manually moved into a plurality of differing shapes while at the same time exhibiting enough strength to maintain its position during dusting or cleaning. As illustrated by FIGS. 5 and 6, such shapes include bending the flexible cleaning pad support member 26 to form a 90° angle, or wrapping a portion of the flexible cleaning pad support member 26 around a spindle or rod. A wide variety of other configurations may also be formed. The cleaning pad can be inserted from either end, enabling the user to maximize the utility of the pad, since the portion furthest from the user gets dirtiest fastest.

In the illustrated preferred embodiment, the elongated flexible cleaning pad support member 26 is of the type marketed by Lockwood Products, Inc. under the trade designation LOC-LINE. This product is typically used as a modular hose system for providing high volume fluids for cooling tools, such as in cutting operations. The elongated flexible cleaning pad support member 26 comprises a plurality of interconnected segments 40. Although the cleaning pad support member may be constructed in a wide variety of sizes depending on the intended use, in the preferred embodiment the elongated flexible cleaning pad support member 26 is approximately 12.5 inches long.

As illustrated in FIGS. 2 and 4, each segment 40 comprises a central body portion 42, a male end portion 44 and a female end portion 46. The male end portion 44 has an outer surface 48 comprising a frustum of a sphere and the female end portion 46 has a mating inner surface 50 comprising a frustum of a sphere which is dimensioned so that, when the male end portion 44 is inserted into the female end portion 46, there is frictional contact between the mating male end portion outer surface 48 and female end portion inner surface 50. These frictional forces function as retaining means to hold one segment 40 at any desired location relative to an interconnected segment 40. However, these frictional forces can be overcome permitting interconnected segments 40 to be moved relative to each other so that their longitudinal axes are either in or out of alignment and permitting unrestricted relative rotational movement therebetween. Thus, the static friction hold the segments in place and is overcome when a user initially starts moving the segments. Once in motion, it's the low dynamic friction that makes the segments 40 easy to move. This connection permits the attached cleaning pad 28 to have the same relative movements as the interconnected segments, as described above. The length of the elongated flexible cleaning pad support member 26 can be changed by adding or removing segments 30.

In one embodiment, the interconnected segments 30, closest the handle portion (e.g. extending about 6 inches from the handle portion) are stiffer than the remaining interconnected segments 30. This allows the tool to better hold its shape when used especially on flat surfaces. Otherwise the handle becomes perpendicular to the work surface, as opposed to the preferred use angle. In order to ensure such an effect, the first six inches of the segments 30 could be encased in rubber heat shrink tubing.

At the end of the flexible cleaning pad support member is a cone shaped end member 52. Cone shaped end member includes a pointed tip 53 a central body portion 54, and a female end portion 56 configured to receive the male end portion 44 of a segment 40. The pointed tip 52 may include an aperture therein for the discharge of a cleaning solution in one embodiment of the design. As it can be appreciated from the attached figures, the entire design of the flexible support member 26, provides an exterior surface that makes it easy to slide the cleaning media over the cleaning support member onto the cleaning tool 22. Likewise, due to the outer edge of the female end portions 46, the cloth is retained onto the cleaning pad support during dusting.

Although not shown, it should be recognized that handle portion 24 and flexible cleaning pad support member 26 could define a fluid delivery passage. The handle portion 24 could house a liquid that could be selectively discharged from the flexible cleaning pad support member using a variety of known means. The fluid may be comprised of a variety of known products. Preferably the fluid is selected from the commercially available Pledge® Multi-Surface Cleaner, Pledge® Wood and Glass Cleaner, End Dust®, Fantastic® all purpose cleaner, Windex® glass cleaner, anti-bacterials such as Oust® or Lysol®, fragrances such as Glade®, leather or vinyl treatment such as Armor All®, fabric protectors such as Scotch Guard®, or fabric fresheners such as those manufactured by S.C. Johnson & Son, Inc. of Racine, Wis., or Febreze®. The fluid may alternatively generally comprise, without limitation: any all-purpose cleaner, oil or water based dust inhibitor, anti-static, anti-microbial, antibacterial, sanitizing and de-odorizing agent, dusting agent, glass cleaner, furniture polish, leather or vinyl treatment, other cleaning agent, wax, polish or shining agent, softening agent, friction-enhancing compound, perfumes, dish cleaner, soap, insect repellent or insect barrier, exfoliator or other personal care product, paint for sponge painting or other application, water out emulsions, oil out emulsions, dust mite killer or repellant, abrasive cleaner, shoe polish, pet sanitation products, etc.

Cleaning pad 28 is generally known in the art and comprised of a combination of fibers defining a cleaning surface 60 and attachment portion 62. The cleaning pad 28 may, for example, include a plurality of fluffed nonwoven fabrics made of synthetic resins, which may be welded to one another. The pad may include fibers constructed from PP, PE, PET fibers in a variety of alternative percentages by weight. In the illustrated embodiment, attachment portion 62 defines a pocket or sleeve 64 configured to tightly fit over support member 26. Attachment portion 62 may be constructed from an elastic material to snuggly fit over the support member 26. Although in the illustrated embodiment, sleeve 64 is illustrated as having an open end 51 and a closed end 52, it should be recognized that the sleeve 64 could have two open ends to allow the cleaning pad to be reversible and insertable on the support member 26 from either end. The reversibility of the cleaning pad 26 allows for maximum use of the cleaning pad. It has been shown that during dusting the tip of the cleaning pad furthest from the handle 24 accumulates the most dust.

The reversibility of the cleaning pad 26 allows for maximum usage of the cleaning surface 60 of the cleaning pad 26.

While in the illustrated preferred embodiment, the cleaning pad 28 includes an elastic attachment portion 62, it is recognized that alternative configurations could be utilized to retain the cleaning pad 28 on the support member 26. For example, Velcro® or rubber bands could be included on a segment of the attachment portion 62 in order to retain the cleaning pad on the cleaning pad support member 26. Other support structures or retaining features could be used to retain the cleaning pad 28 on the support member 26.

Cleaning pad 28 is preferably, a 20 g/sqm spun lace cloth with between 1-4% mineral oil manufactured by Haso Corporation of Japan. Such cleaning or dusting pads are described in PCT/JP2004/10507 the entirety of which is expressly incorporated by reference.

The cleaning surface 62 of cleaning pad 28 may be comprised of a polymer that allows for the spontaneous transport of aqueous fluids. Such polymers are described in, for example, U.S. Pat. Nos. 5,723,159, 5,972,505 and 5,200,248 the disclosures of which are expressly incorporated by reference.

It should be recognized that the polymer fibers of the cleaning pad can take a variety of forms to increase various performance characteristics of the cleaning system 20. Standard circular fibers may be used, as is generally known in the art. Alternatively, the individual fibers on the cleaning pad may be lobed in the form of loose tow fibers. The unique lobed configuration creates channels within the individual fibers enabling improved capillary action on each individual fiber and increasing the overall cleaning or dusting surface area thereby increasing the overall efficiency of both wet and dry dusting. The higher surface area results in an increase in the proportion of particles adhering in the grooves or channels and results in dust particles being "trapped" within the grooves of the lobed fiber. The lobed fibers generally exhibit improved dust retention, more efficient wet wiping and longer life than standard circular fibers. Furthermore, the lobed fibers can be made stiffer thereby generating a higher wiping pressure in a smaller contact area It is understood that the inventive lobed fibers could be comprised of a multitude of polymers with PP, PE or PET being recognized as the most cost effective alternatives. Alternatively acrylic or biodegradable polymers could be utilized.

In another alternative embodiment, the cleaning pad 28 may include stiffer or strut fibers attached to mass of tow fibers. In this arrangement, the stiffer fibers (usually in the range of about 0.3 mm) carry the majority of the stress applied to the cleaning pad 28. The tow may be linked to the stronger fibers by entanglement at the outer ends of the fiber. The stiffer fibers result in a cleaning pad 28 that is springy resulting in a more desirable feel of applied force for users. The stiffer fibers can further be utilized to clean difficult areas such as crevices, blinds or screens. The stiffer fibers have the further advantage in that they keep the tow volume expanded, thereby increasing dust migration into the tow fibers.

In yet another alternative embodiment, the cleaning pad 28 could include absorbent materials in particulate form fixed onto the remaining fibers of the cleaning pad 28. The absorbent materials may take the form of known super absorbent polymers SAP. The SAPs may be, for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391 the disclosure of which is hereby expressly incorporated by reference.

The absorbent materials increase the overall absorbency of the fibers, prevent the fibers from packing close together into a fiber mass, and enhance the friction of the fibers. The "string of pearls" arrangement also allows for strategically placed high absorbency regions on the cleaning pad. For example, if it is desirable to have the forward end of the cleaning pad 28 be more absorbent than the remainder of the cleaning pad 28, the forward end could include a higher percentage of the particulate absorbent materials.

The cleaning pad 28 could also include fibers that are formed into helices. Such fibers can be formed by drawing fiber bundles over a blade or heating coaxial bicomponent fibers. The resulting helical fibers exhibit a fluffier texture and more attractive appearance while at the same time increasing the volume (while using less fiber) and dust retention of the duster. The helical nature of the fibers is also advantageous in that they allow coarse fibers to feel softer due to the spring effect. Furthermore, the fibers gradual loss of the helical nature, can serve as an indication of the effective life of the cleaning pad.

In one embodiment the cleaning pad may be comprised of three component sheets or layers. Two sheets form the carrier or base and they are attached to a cleaning or wipe-off layer of nonwoven fibers. The two part carrier includes an outermost or top sheet forming the sleeve or pocket 64 configured to receive the flexible cleaning pad support member. Beneath the pocket is a second carrier sheet. The carrier layer includes a plurality of fringes or strips extending along its lateral sides. Underneath the second carrier layer is the wipe-off layer. The wipe-off layer is comprised of tow fiber (loose nonwoven fibers). The tow is a bicomponent fiber consisting of a polypropylene core and a polyethylene outer surface. The three component layers are bonded to each other by a central heat-seal line extending through the center of the three component layers. Along the opposed edges of the pocket layer, are a series of spot welds.

In another embodiment, a base carrier layer is bonded to the tow fibers via a central weld line and a series of spot welds running along the lateral sides of the cloth. The spot welds only bond the carrier sheet and the tow fiber. Two additional layers are attached to the base carrier layer to form the pocket or sleeve 64. The pocket layers are sealed with continuous heat seal lines extending between the two exterior pocket layers. The tow fiber is also bicomponent, but it consists of a polypropylene core and a polyester outer layer. In another preferred embodiment, polypropylene or nylon fibers are welded to the center of the tow fiber.

It should be recognized that none of the aforementioned fiber materials or configurations are exclusive. The cleaning pad could include strategic combinations of the various fibers and other known fibers. In one example, the cleaning pad may be comprised of between 25-100% of the lobed fibers by weight.

Similarly, although the preferred embodiment discloses a 360° uniform cleaning surface 62, the invention is in no way limited to such a single cleaning surface. To the contrary, numerous alternative configurations are within the scope of the present invention. For example, the inventive pad could include multiple cleaning surfaces, with alternate or similar fiber configurations to accommodate various cleaning functions. In one embodiment, a cleaning pad 28 could be two sided with one side of the cloth for dusting and the alternate side of the cleaning pad 28 for cleaning. This could also be accomplished by turning the pad "inside out" to expose a new clean surface. Alternatively, a triangular or other multi-sided cleaning pad 28 could be utilized. In general, a variety of cleaning pad 28 shapes or configuration could be utilized to maximize the various properties of the cleaning pad 28 and selected fibers.

As noted above, the orientation and type of fibers utilized on the cleaning pad 28 could include a wide variety of alternatives. For example and in no way limiting, the cleaning pad 28 could include a generally fluffy pad including a flat center strip around the area defined by the pockets or sleeves 64. Such an orientation may increase the surface area and exhibit a better efficacy. Additionally, the center strip could include an absorbent pillow or tube extending down the center of the cleaning pad 28. Such an absorbent pillow could provide an area of high absorbency on the cleaning pad 28. Various alternative combinations are envisioned including, for example, cleaning pads consisting of alternating sections of sponges, feather-like structures, micro-fibers or cellulose foam. Wood pulp is preferred.

The cleaning pad 28 could also include a fluffy cloth with a hydrophilic additive to improve the absorbency of water. Such hydrophilic additives include but are not limited to glycerin and glycols. The cleaning pad 28 could also be comprised entirely of an absorbent material such as Rayon.

The cleaning pad 28 or cleaning pad support member 26 could also include a piezoelectric crystal to impart an electrostatic charge on the cleaning pad during use to increase dust retention. Such crystals are generally known and typically generate a charge when subjected to mechanical stress. Examples of materials that can be used include but are not limited to quartz analogue crystals like berlinite ($AlPO_4$) and gallium orthophosphate ($GaPO_4$), ceramics with perovskite or tungsten-bronze structures ($BaTiO_3$, $KNbO_3$, $LiNbO_3$, $LiTaO_3$, $BiFeO_3$, $Na_x$ $WO_3$, $Ba_2NaNb_5O_5$, $Pb_2KNb_5O_{15}$). Additionally some Polymer materials like rubber, wool, hair, wood fiber, and silk exhibit piezoelectricity to some extent and may be utilized. Additionally, the polymer polyvinylidene fluoride, ($—CH_2—CF_2—$), which exhibits piezoelectricity several times larger than quartz may be used.

The cleaning pad 28 may also include a portion of an unbonded web material, as described in U.S. Pat. Nos. 5,858,112, issued Jan. 12, 1999 to Stokes et al. and 5,962,112, issued Oct. 5, 1999 to Haynes et al. or other material such as described by U.S. Pat. No. 4,720,415, issued Jan. 19, 1988 to Vander Wielan et al. or any super absorbent material such as described in U.S. Pat. Nos. 4,995,133, issued February 1991 and 5,638,569 both issued to Newell, 5,960,508, issued Oct. 5, 1999 to Holt et al., and 6,003,191, issued Dec. 21, 1999 to Sherry et al., all of which are hereby expressly incorporated by reference herein, in their entirety.

In one embodiment, the cleaning pad 28 may comprise a spunbond fiber nonwoven web having a basis weight of approximately 68 grams per square meter. The spunbond fibers may comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity. The spunbond fiber nonwoven web is thermally bonded with a point unbonded pattern. The nonwoven web is bonded using both heat and compacting pressure by feeding the nonwoven web through a nip formed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 28.

Alternatively, the pad 28 may comprise a laminate of an air-laid composite and a spunbond fiber nonwoven web. The nonwoven web may comprise monocomponent spunbond fibers of polypropylene having a basis weight of approximately 14 grams per square meter. The air-laid composite may comprises from about 85% to about 90% kraft pulp fluff and from about 10% to about 15% bicomponent staple fibers. The bicomponent staple fibers may have a sheath-core configuration; the core component comprising polyethylene terephthalate and the sheath component comprising polyethylene. The air-laid composite has a basis weight between about 200 and about 350 grams per square meter and an absorbency of between about 8 and about 11 grams per gram.

The cleaning pad 28 may also include a portion or side of hydrophilic fibers useful for scrubbing. Additionally, nylon fibers may be used to increase the coefficient of friction when they become wet. Portions of the cleaning pad 28 may be composed of microfibers and ultra-microfibers having a denier per filament (dpf) less than or equal to about 1.0.

As described, the cleaning pad 28 can be formed by any material or material-forming process known, including woven and non-woven materials, polymers, gels, extruded materials, laminates, layered materials which are bonded together integrally and thus form a co-material, fused materials, extruded materials, air laying, etc.

The cleaning pad 28 can alternatively be optimized for providing a cleaning fluid to the surface, such as with micro capsules or encapsulated fluids or agents. The enhanced surface of the cleaning pad 28 can have scrubbing or abrasive qualities. The enhanced surface can also be formed by a mechanical stamping, bonding, pressing, compression, extrusion, sprayed, sputtered, laminated or other surface forming or affecting process. The various alternative cleaning solutions discussed above could be microencapsulated into the cleaning pad such that they are selectively released by some additional stimulus. It is understood that various cleaning solutions microencapsulated into the cleaning pad could be activated by water, another chemical in the fluid reservoir or pressure. The solutions could be dry impregnated. Alternatively, the chemical solutions could be encapsulated in pockets or bubbles on or within the pad 28 or on the cleaning pad support member 26. The pockets could be designed to burst and release the cleaning solution upon the application of moderate pressure.

FIGS. 1, 5 and 6 illustrate the inventive cleaning system in alternating but non-limiting positions. FIG. 5 illustrates the cleaning system 20 in a cleaning position suitable for cleaning behind appliances such as a stereo 70. As illustrated in FIG. 6, the flexible cleaning pad support 26 maybe bent at an angle of about 90° in relation to the handle portion 24, such that a user can dust the back surface 72 of the stereo without moving the stereo 70 or any of its component parts. In order to form the 90° angle a user simply bends the flexible cleaning pad support member 26 at a desired junction. Thus, in the cleaning position, a user may manipulate the cleaning system 20 via the handle portion 24.

FIG. 6 illustrates the cleaning system 20 in a second hook-like cleaning position suitable for cleaning or dusting circular features such as the spindle 81 of a staircase 83. In order to move the cleaning pad support member 26 from the first position illustrated in FIG. 5 to the position in FIG. 6, a user must hold the handle portion 24 and apply torque to the flexible cleaning pad support member 26 to move it from the cleaning position illustrated in FIG. 1 to the curved orientation illustrated in FIG. 6. As sufficient torque is applied to overcome the forces of the flexible support member, the support member rotates downwardly into the position illustrated in FIG. 6. FIG. 1 illustrates the cleaning system in yet another alternative cleaning position. In FIG. 1, the cleaning pad support member is straight and in substantial alignment with the axis of the handle portion 24. This cleaning position is suitable for the cleaning of large surfaces such as a dining room table. During dusting or cleaning a user may repeatedly rotate the cleaning pad support member to any variety of cleaning positions as needed.

Methods of Use and Methods of Cleaning

It should be appreciated from the above disclosure that the preferred cleaning tool 22 can be utilized to clean or dust a variety of surfaces. Due to the unique configuration of the tool 22 a user can conveniently alternate the orientation of the cleaning tool 22. It is recognized that the component parts of the invention may be conveniently interchanged depending on the particular cleaning task at hand. For example, some of the disclosed cleaning pads 28 may be more suitable for use with some of the disclosed cleaning solutions or for dry dusting. Likewise, some cleaning pads 28 may include alternate surfaces configured for alternative cleaning tasks. Similarly, the particular cleaning solution utilized can be changed depending on the desired application.

In order to perform cleaning a user may obtain the above mentioned cleaning system 20 that includes the preferred cleaning tool 22. A user holds the cleaning tool 22 such that the palm of the users hand surrounds the handle portion 24.

Once the user obtains the tool 22, a user then places the cleaning pad 28 onto the flexible cleaning pad support member 26. As noted above, the cleaning tool may be used with a variety of alternative cleaning pads 28. In the preferred embodiment, the sleeve-like cleaning pad 28 is mounted over the cleaning pad support member 26 so that all of the sections 40 are within the sleeve 64. Once secured, the user then positions the cleaning pad 28 onto a surface to be cleaned and moves the cleaning pad 28 on the surface to be cleaned. The movement of the cleaning pad 28 across the surface to be cleaned causes dust or other debris to be collected by the cleaning pad 28. In the illustrated embodiment, dust or other debris is collected by the cleaning surface 60 of the cleaning pad 28. The user may, depending on the surface to be cleaned, move the cleaning pad support member 28 to accommodate hard to reach places. For example, if a user desires to dust an overhead lintel, the user may pivot the cleaning pad support member 26 to an angle of about 90° in relation to the handle portion 24.

A preferred dusting or cleaning pattern consists of a side to side overlapping motion starting in the upper left hand (or right hand) side of the section to be cleaned, and progressing the wiping pattern across the surface to be cleaned continuing to use side to side wiping motions. Another preferred wipe pattern consists of an up-and-down wiping motion. The preferred wiping patterns allow the cleaning pad 28 to loosen dirt and dust, and provide a better end result. Another benefit of the above wiping patterns is minimization of streaks as a result of improved spreading of solution (in wet dusting). Additionally a user can bend the support member 26 into a "U" shape, so as to provide twice the dusting surface passing over a given space.

Once the cleaning or dusting has been finished, the user may remove and dispose of the cleaning pad 28. As noted above, a variety of cleaning solutions can be used with the inventive cleaning system. In one preferred method of light cleaning or dusting a solution comprising 96.5125% by weight deionized water, 1.75% propan-2-ol anhydrous, 0.40% ethylene glycol monobutyl ether, 0.40% ethylene glycol n-hexyl ether, 0.125% propylene glycol, 0.10% monoethanolamine, 0.30% vinegar (white distilled 300 grain), and small amounts surfactants and other ingredients is utilized. This composition is ideally suited for dusting jobs. Use of the preferred solution with the inventive cleaning solution provides an increase in dust and allergen retention as well as providing an improved shine to the surface to be cleaned. Fingerprints, smudges and other blemishes are also easily removed.

Optionally, and most preferably, convenience and performance can be maximized by using a system composed of a disposable cleaning pad 28 as described hereinbefore. The pad can be composed of any one of the alternative cleaning pads 28 described above.

This cleaning system 22 and method of use provides multiple benefits versus conventional cleaning modes. It reduces time to clean or dust, because the cleaning pad retains a greater amount of dust and the preferred cleaning solution removes fingerprints smudges and other surface marks. Additionally, since a fresh pad 28 may be used every time, germs and dirt are trapped, removed and thrown away, promoting better hygiene. Conventional dusting tools, which are reusable, can harbor dirt and germs, which can be spread throughout the household.

The cleaning pads 28 are versatile in that they can be used for multiple cleanings and multiple surfaces. Each pad is designed to clean at least one average size surface with an average debris or dust load. Pads can be changed sooner if surfaces are larger than average, or especially dirty. To determine if the pad needs changing, look at the back of the cleaning surface of the cleaning pad and ascertain if the cleaning surface is saturated with dust and/or dirt.

To maximize the synergy between the various cleaning, and dusting tasks, the present methods can be carried out using several varying executions and instructions for use. In one embodiment, a kit can be provided that has multiple cleaning pads and solutions for different cleaning tasks. One solution and cleaning pad could be used for surface cleaning and another solution and pad for dusting. The kit may be sold separately with advertising and instructions in each kit being used to explain the benefits of using the various products together.

It is understood that the component parts of the inventive system 20 described above may be manufactured and sold separately or together in the form of a cleaning system or kit. It should be further understood the present invention contemplates a variety of additional alternative configurations and component parts which may be attached to the cleaning pad support member. A wide variety of alternative interchangeable cleaning implements may be substituted for the cleaning pad support member 26 described above. The alternative cleaning implements would preferably include a support member with a design which includes at least one of the sections 40 or other attachment member similar to that described in the preferred embodiment such that the alternative implements could be used interchangeably with the preferred handle portion 24 and support member 26. For example, and in now way limiting an alternative cleaning implements could include a squeegee for cleaning windows, mirrors or other glass structures, a soft surface cleaner such as a lint roller, a glass cleaner including an indexing refill roll, an insect swatter, a dog brush or other grooming implement, a scrub brush, sponge, mop, paint brush, toilet brush or other cleaning implement etc. Numerous other cleaning implements are also within the scope of the present invention.

Furthermore, although the preferred embodiment illustrates a flexible cleaning pad support 26 constructed from a plurality of individually rotatable segments, it is recognized that the present invention is in no way limited to such a construction. For example, the cleaning pad support 26 could be constructed from vinyl covered wire, Bx cable or other known flexible materials.

The cleaning pad support 26 could alternatively be connected to the handle portion via a threaded connection. Such an orientation would allow for the ease of attachment and removal of the numerous alternative cleaning implements that are within the scope of the present invention.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a cleaning system that includes a flexible support. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A cleaning device comprising:

a handle;

a cleaning pad support member having a plurality of rotatably interconnected segments attached to the handle at one end, wherein each segment has a rounded male end and a female end for receiving a male end of an adjacent segment; and a cleaning pad having a plurality of non-woven fiber bundle layers defining a cleaning surface and a first and second base sheet defining a sleeve configured to be tightly fit over the cleaning pad support member;

wherein the handle comprises an integral cleaning pad support member connection portion and a rounded user holding portion;

wherein the cleaning pad support member has a wider width at a first end and a narrower width at a second end and further comprises an outer edge portion; and wherein the cleaning surface of the cleaning pad extends about 360° around the cleaning pad support member when the cleaning pad is retained thereon.

2. The cleaning device of claim 1, wherein the sleeve has openings at both ends such that the cleaning pad support member may be inserted into either end of the cleaning pad.

3. The cleaning device of claim 2, further comprising a retaining feature; wherein the cleaning pad is retained on the cleaning pad support member via the retaining feature.

4. The cleaning device of claim 1, wherein the fiber bundle layers are located on outer surfaces of the first and second base sheets.

5. The cleaning device of claim 4, wherein the fiber bundle layers are bonded together and to the first and second base sheets via at least one of: a central joining portion and spot weld portions.

6. The cleaning device of claim 5, wherein the first and second base sheets are bonded to one another via a plurality of spot welds.

7. The cleaning device of claim 6, wherein at least a plurality of fibers in the fiber bundle layers are bonded to at least one of the first and second base sheets via the spot welds.

8. The cleaning device of claim 1, wherein the cleaning pad is a 20 g/sqm spun lace cloth with between 1-4% mineral oil and wherein the fiber bundle layers include fibers constructed from at least one of: PP, PE and PET fibers.

9. A cleaning tool comprising:

a handle;

a cleaning pad support member attached to the handle at one end;

a cleaning cloth comprised of two non-woven sheets bonded together to define a sleeve having two open ends, each non-woven sheet having an inner surface and an outer surface;

two fiber bundle layers, each fiber bundle layer positioned on and bonded to the outer surface of a respective non-woven sheet;

a central bonding line that extends through the non-woven sheets and fiber bundle layers to bond the non-woven sheets and fiber bundle layers together, wherein the non-woven sheets are bonded such that the respective inner surfaces of the sheets are facing one another; and a series of spot bonds on either side of the central bonding line that bonds the respective fiber bundles to the respective non-woven sheets;

wherein each fiber bundle layer extends uninterruptedly across the sleeve to define a cleaning surface extending about 360° around the cleaning pad support member when the cleaning cloth is retained thereon.

10. The cleaning tool of claim 9, wherein the central bonding line is a heat seal line.

11. The cleaning tool of claim 9 wherein the cleaning pad support member includes a plurality of rotatably interconnected segments attached to the handle at one end, and wherein each segment has a rounded male end and a female end for receiving the male end of an adjacent segment.

12. A cleaning implement comprising:

a handle having a cleaning pad support member; and a cleaning cloth comprising:

a first non-woven sheet and a second non-woven sheet, each sheet having an inner surface and an outer surface; and a fiber bundle having fluffed non-woven fibers bonded to the outer surface of the first sheet at a central bonding line;

wherein the sheets are bonded to each other via spot joining portions positioned on either side of the central bonding line to define a sleeve for receiving the cleaning pad support member, the sleeve having openings on two ends;

wherein the first sheet is situated between the second sheet and the fiber bundle such that the inner surface of the first sheet faces the inner surface of the second sheet; and wherein the fiber bundle extends uninterruptedly across a longitudinal axis that is substantially coaxial with the handle to provide a cleaning surface that extends about 180° around the longitudinal axis.

13. The cleaning implement of claim 12, wherein the handle comprises:

an ergonomic holding portion; and a singular cleaning cloth support member connected to the holding portion;

wherein the cleaning cloth support member comprises an outer edge portion.

14. The cleaning implement of claim 13, wherein the cleaning cloth is retained on the handle via a frictional force between the outer edge portion and the sleeve.

15. The cleaning implement of claim 13, wherein the cleaning cloth support member comprises a narrow insertion portion to facilitate placement of the cleaning cloth onto the support member.

16. The cleaning implement of claim 13, wherein the cleaning cloth further comprises an attachment portion for retaining the cloth on the handle.

17. The cleaning implement of claim 12, wherein the fiber bundle is a first fiber bundle, and wherein the cleaning implement further comprises a second fiber bundle bonded to the outer surface of the second sheet, the second fiber bundle combining with the first fiber bundle to provide a cleaning surface that extends about 360° around the longitudinal axis.

18. The cleaning implement of claim 17, wherein the central bonding line bonds the two sheets, the first fiber bundle and the second fiber bundle together.

* * * * *